US005993976A

United States Patent [19]

Sahoo et al.

[11] Patent Number: 5,993,976

[45] Date of Patent: Nov. 30, 1999

[54] STRAIN TOLERANT CERAMIC COATING

[75] Inventors: Purusottam Sahoo, Collegeville; Stephen Sitko, Telford, both of Pa.

[73] Assignee: Sermatech International Inc., Limerick, Pa.

[21] Appl. No.: 08/971,787

[22] Filed: Nov. 18, 1997

[51] Int. Cl.[6] ..... B32B 3/00

[52] U.S. Cl. ..... 428/472; 427/446; 427/453; 428/332; 428/469; 428/697; 428/701; 428/702

[58] Field of Search ..... 428/697, 699, 428/701, 702, 472, 469, 457, 212, 332; 427/453, 446

[56] References Cited

U.S. PATENT DOCUMENTS

| | | | |
|---|---|---|---|
| 4,457,948 | 7/1984 | Ruckle et al. | 427/34 |
| 5,073,433 | 12/1991 | Taylor | 428/134 |
| 5,514,482 | 5/1996 | Strangman | 428/623 |
| 5,520,516 | 5/1996 | Taylor et al. | 416/241 B |
| 5,743,013 | 4/1998 | Taylor et al. | 29/889.7 |

OTHER PUBLICATIONS

Sumner, I.E. and Ruckle, D.L., "Development of Improved–Durability Plasma Sprayed Ceramic Coatings for Gas Turbine Engines", AIA/SAE/ASME 16th Joint Propulsion Conference (1980).

Johner, G. et al., "Experimental and Theoretical Aspects of Thick Thermal Barrier Coatings for Turbine Applications," Thermal Spray: Advances in Coatings Technology, National Thermal Spray Conference (1987).

Taylor, T.A. et al. "Plasma–Sprayed Yttria–Stabilized Zirconia Coatings: Structure–Property Relationship", *Surface and Coatings Technology,* 43/44 (1990), pp. 470–480.

*Primary Examiner*—Archene Turner

*Attorney, Agent, or Firm*—Seidel Gonda Lavorgna & Monaco, PC

[57] ABSTRACT

A strain tolerant ceramic coating, preferably for use as an abrasive coating on a substrate is provided. The coating is prepared from a yttria and zirconia powder having an average particle size less than 40 microns. The coating is formed by depositing the powder on the substrate by a plasma spray process. The as-applied coating contains essentially no macrocracks, but a post-stressed coating contains a random distribution, population, and orientation of microcracks and macrocracks.

22 Claims, 8 Drawing Sheets

A31(1) X100 Panel: As Sprayed

A31(1) X100 Panel: As Tested

A31(2) X100 Panel: As Sprayed

A31(2) X75 Panel: As Tested

A31(2) X75 Blade: As Sprayed

A31(2) X75 Blade: As Tested

STRAIN TOLERANT CERAMIC COATING

FIELD OF THE INVENTION

The invention relates to the field of protective coatings for machine parts, and more specifically to strain tolerant ceramic coatings for turbine blades.

BACKGROUND OF THE INVENTION

Turbine blades rotate about a central axis of a gas turbine engine. Blades may rotate within the compressor portion of the turbine or the "hot" combustion portion of the turbine. An engine case (the "seal") shrouds the turbine blades. The tips of the turbine blades and seal are maintained in very close relation because the efficiency of the turbine engine is inversely related to the leakage of gases between the turbine blades and the seal.

While rotating at high speeds, the tips of the turbine blades often contact the seal. Such contact can result in wear damage to the blades from abrasion caused by shear forces on the blades. Wear damage to the tips of the blades results in decreased engine efficiency and expensive replacement costs. To minimize damage to the turbine blade tips from contact with the seal, the blade tips may be either made from materials harder than the seal or coated with a material harder than the seal. An effectively "harder" blade tip avoids wear damage to itself by instead abrading the seal.

It is known in the art of turbine blade coatings that the desirable properties of a coating are dependent on a variety of factors, including chemical composition, method of application, coating density, existence of cracks (microcracks and macrocracks) in the coating, and the thickness of the deposited coating layer(s). All of these variables have a direct impact on coating costs and coating performance, thus presenting the designer with a variety of trade-off considerations.

U.S. Pat. No. 5,073,433 to Taylor discloses a thermal barrier coating. A thermal barrier coating is designed to protect turbine blades from thermal strain attributable to temperature cycles in the engine. The Taylor '433 thermal barrier coating is prepared from yttria (6–10 wt %) and zirconia powder having a mean particle diameter of about 40 microns. The coating is applied using a plasma spray process so as to intentionally generate between 20 and 200 vertical macrocracks per linear inch of the coating.

The coating of the Taylor '433 patent is applied by a complex process requiring repeated deposition (and cooling) of monolayers. This application process intentionally produces homogeneously distributed macrocracks throughout the coating. Construction of such a coating is time-consuming and dependent upon close control of process parameters. Abrasion resistance is not disclosed as a function of the Taylor '433 coating.

U.S. Pat. No. 5,520,516, also to Taylor, discloses a yttria-stabilized zirconia coating for turbine blade tips that provides abrasion resistance to the blade tips. This coating is applied to a turbine blade tip in a manner identical to that disclosed in the Taylor '433 patent, that is, by a complex process of monolayer deposition (and cooling) with the intent of creating at least 5 vertical macrocracks per linear centimeter of the coating. A post-deposition vacuum heat treatment is also recommended. The Taylor '516 patent further teaches that the applied coating be configured with a prescribed coating thicknesses at the edge of the blade tip to prevent shear adhesion failure of the coating on the blade tip.

U.S. Pat. No. 4,457,948 to Ruckle, et al. discloses a thermal barrier coating by plasma spraying. After deposition of a bond coat and a ytrria-stabilized zirconium ceramic coating, the resulting coating is heated to a temperature in the range of 820 centigrade to 1150 centigrade, then rapidly quenched (in, for example, liquid tin at 220 centigrade). The quenching operation produces an irregular pattern of cracks throughout the coating creating a columnar, segmented structure and a segmented, cracked coating surface.

Because of the inherent tendency of ceramic coatings to crack and the failure to withstand mechanical stresses, yttria-stabilized coatings have found wider application as thermal barrier coatings. Indeed, such careful preparation and prescribed edge thicknesses are necessary in the prior art use of yttria-stabilized zirconia for abrasive blade tip coating applications.

The present invention overcomes deficiencies in ceramic coatings, and in particular, abrasive blade tip coatings known to date. These deficiencies include the substantial expense required to apply these coatings in order to achieve the desired physical and mechanical properties. The coating of the present invention provides improved abrasion resistance with the attendant advantage of being applied in a simple application scheme. The present invention achieves a strong coating—substrate bond resistant to abrasive shear forces. The coating of the present invention exhibits a high tensile bond strength and very high lap shear strength, characteristics essential to a rub tolerant protective coating.

SUMMARY OF THE INVENTION

A strain tolerant ceramic coating ("STCC") for use on a substrate is provided. A typical, but by no means the only, application is as an abrasion resistant coating on compressor or hot turbine blade tips. The coating comprises yttria and zirconia and is prepared from a ytrria and zirconia powder having an average particle size less than 40 microns and is preferably formed by depositing the powder on said substrate by a plasma spray process An as-applied coating contains essentially no macrocracks and a post-stressed coating contains a random distribution, population, and orientation of microcracks and macrocracks.

The yttria and zirconia powder contains a molar ratio of zirconia to yttria in the range from about 18:1 to about 29:1. The applied coating of the invention has a theoretical density greater than 88%.

The coating of the present invention exhibits excellent lap shear strength, as evidenced by the coating deposited on a substrate having a substrate/seal segment wear ratio of less than 0.05 as determined by a rub rig test against a corresponding seal segment at a speed of 800 ft/s at a target rub depth of 30 mils (0.030 inches). The coating of the invention exhibits a Vickers hardness greater than 800 $HV_{300}$ and a bond strength with the substrate greater than 10,000 psi.

A metal article coated with a coating comprising yttria and zirconia is also provided. The coating is prepared from a yttria and zirconia powder having an average particle size less than 40 microns. The coating is formed by depositing the powder on the article by a plasma spray process. An as-applied coating contains essentially no macrocracks and a post-stressed coating contains a random distribution, population, and orientation of microcracks and macrocracks.

A process for producing a strain tolerant ceramic coating for use as an abrasive blade tip coating on a substrate is also provided. This process comprises the steps of depositing a yttria and zirconia powder on the substrate by thermally melting the powder with a plasma torch and forming a monolayer on the substrate of about 3.0 mil, then repeating these steps at least once until a coating of a desired total thickness is achieved. The powder comprises particles having an average particle size less than 40 microns and the resulting coating contains essentially no macrocracks in the as-applied state, but a post-stressed coating contains a random distribution, population, and orientation of microcracks and macrocracks.

DETAILED DESCRIPTION OF THE INVENTION

The present invention is directed to a strain tolerant ceramic coating ("STCC"), preferably to be used as an abrasive blade tip ("ABT") coating on turbine blades. Though the STCC of the present invention has found particular utility as an ABT, it is not limited to that application. The STCC of the present invention is expected to have utility as a thermal barrier coating, as one example, and is expected to have utility in other applications as well.

The STCC of the invention, in a preferred embodiment as an ABT coating, is a yttria-stabilized zirconia coating, which comprises yttrium oxide $Y_2O_3$ (yttria) in a concentration between about 6 to 9 wt %, and preferably between about 7 to 8 wt %. The balance of the coating is zirconium oxide ($ZrO_2$) (zirconia), except for minor amounts of other constituents which may also be present in the composition. Regardless of the coating formulation, the coating contains a molar ratio of zirconia to yttria in the range from about 18:1 to about 29:1.

In place of zirconia, the STCC of the invention may use aluminum oxide ($Al_2O_3$) or chromium oxide ($Cr_2O_3$). Other oxides, such as those of calcium, magnesium, or cerium, may be substituted in place of, or in addition to, yttria. If desired, other additives may be included in the ABT of the invention to improve thermo-mechanical or thermo-chemical properties. These additives include oxides, such as oxides of strontium, scandium, barium or indium.

In a preferred embodiment, the coating of the invention is prepared from a powder, comprising $ZrO_2$ and $Y_2O_3$, in which the powder particles of ytrria-stabilized zirconia have an average equivalent spherical diameter of less than 40 $\mu$m, such as from about 20 $\mu$m to about 35 $\mu$m. Suitable particles are fused and crushed and are approximately −400 mesh. Yttria-stabilized zirconia particles having such characteristics are commercially available from suppliers such as Sulzer-Metco, Norton, or Zirtech. It is, however, understood that particles of average equivalent spherical diameter less than 20 $\mu$m are also suitable for the STCC of the invention, and that particles of this small size may provide enhanced abrasion resistance of the ABT coating embodiment.

Figure 1:
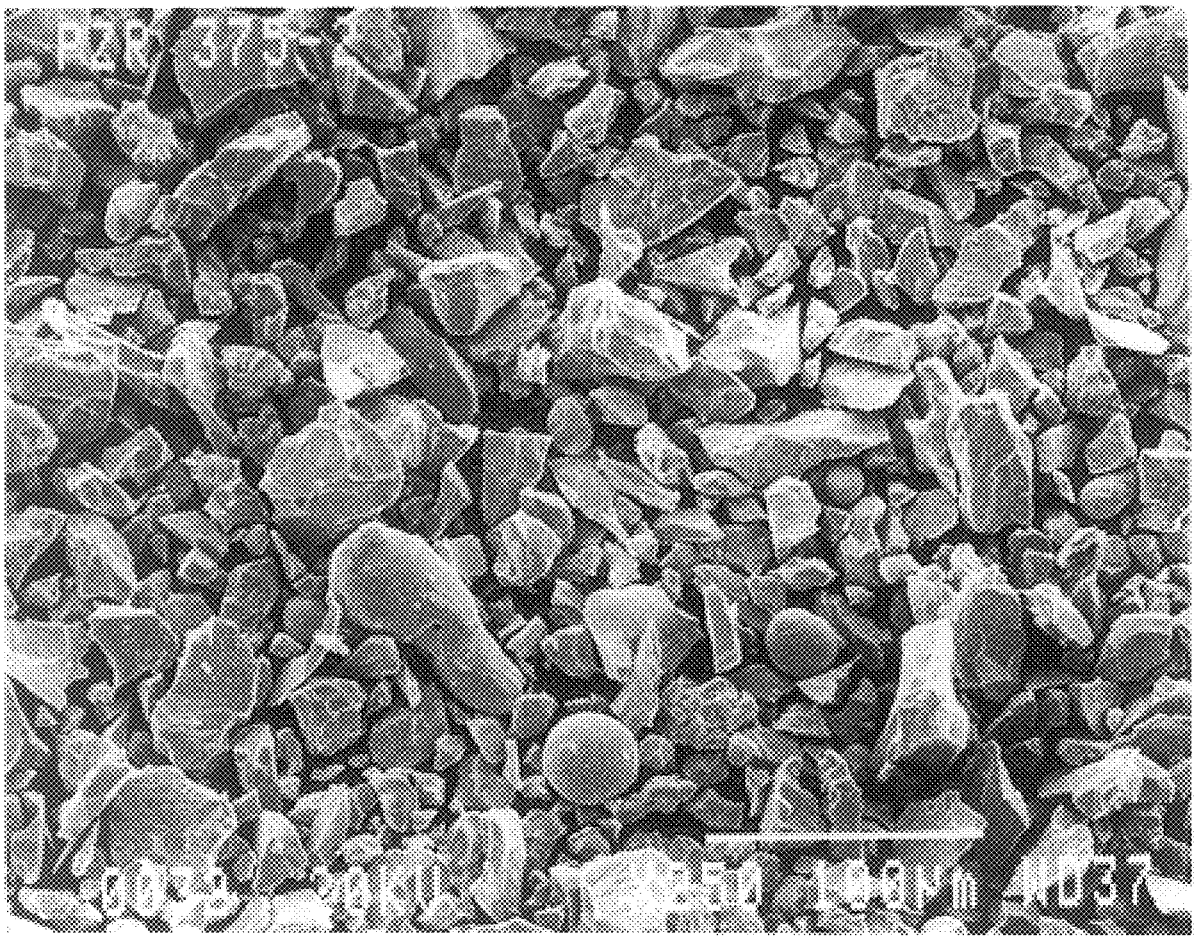
FIG. 1 is a 50X magnification photograph of a yttria-stabilized zirconia powder utilized in the preparation of a strain tolerant ceramic coating of the present invention, particularly showing the irregular particle geometry of a preferred embodiment.

The powder particles used to form the STCC of the invention may have a variety of morphologic structures or geometric forms, such as discrete spheroidized particles, fused particles, sintered particles, or discrete elongated and angular particles. Although not considered to be essential, a preferred embodiment of the powder particles has predominately elongated and angular shape, as shown in FIG. 1.

The density of the coating of the invention, formed from yttria-stabilized zirconia powder particles of suitable size as described above, is above about 90% of theoretical density, and preferably is above about 95% of theoretical density, approaching 100% of theoretical density. Theoretical density of porous materials is determined by processes well-known in the art, such as mercury porosimetry. Theoretical density may also be accurately approximated by conducting a comparative visual analysis with standard photomicrographs of coatings or materials of known densities.

Figure 2:
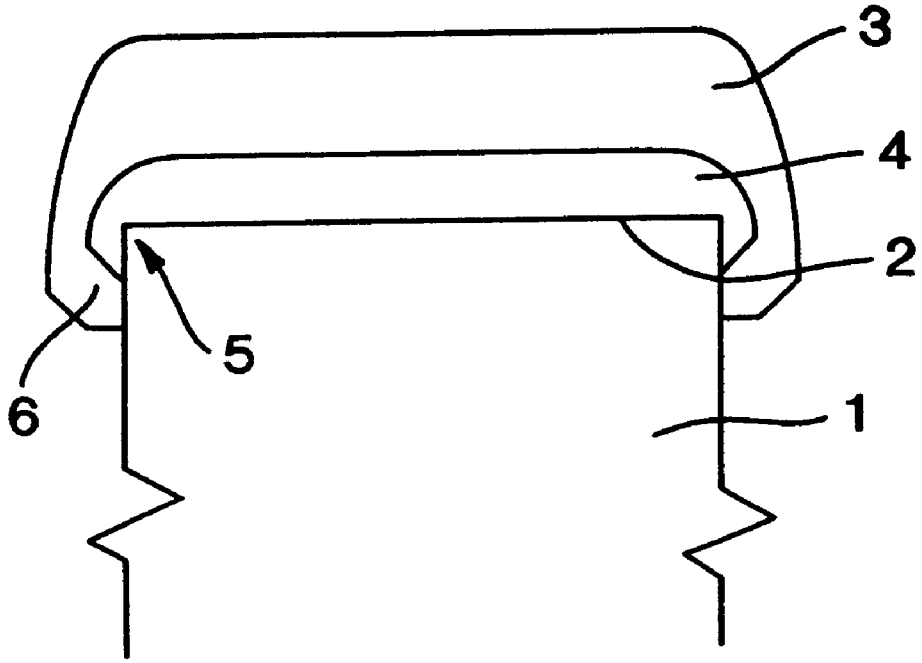
FIG. 2 is a schematic diagram of a turbine blade tip and protective coatings thereon.

The coating of the invention may be applied directly on a substrate, or alternatively, a bond coat may be initially applied to the substrate and the coating of the invention thereafter applied to the bond coat. FIG. 2 is a diagrammatic representation of a turbine blade tip coated with an ABT coating. A turbine blade 1 has a blade tip 2 located at an end opposite the turbine blade's attachment to a rotor. The blade tip 2 is coated with an ABT coating 3. FIG. 2 further depicts the use of a bond coat 4, which is applied to the blade tip 2 prior to the application of the ABT coating 3. The blade tip 1 has an edge 5 having a coating overhang 6.

The bond coat 4 may be used to provide resistance to oxidative conditions encountered during service conditions. A bond coat may also be used to enhance the adhesive properties of the STCC of the invention. A bond coat is preferred to promote adhesion with an ABT coating thereafter applied. If a bond coat is used, it should have a prepared roughness in the range from about 200 to about 600 micro-inches Ra at 0.030 inch cut off. Any conventional or to-be-discovered bond coat that provides resistance to oxidation or enhanced adhesion is suitable as the bond coat to be used in association with the STCC of the invention.

An example of a suitable bond coat is a MCrAIX bond coat, where M is nickel, cobalt, or iron (either alone or in combination), Cr is chromium, Al is aluminum, and X is hafnium, zirconium, yttrium or silicon. If X is yttrium, the bond coat is referred to as a MCrAlY bond coat.

Another example of a suitable bond coat is a nickel aluminide bond coat. Because nickel will react with titanium to form brittle Ti-Ni alloys, nickel-based bond coats are not preferred for use directly on titanium alloy substrates, unless it is desired to form the Ti-Ni alloy.

In one embodiment of the STCC of the present invention, the thickness of an overall STCC used as an ABT coating (or combined thickness of the ABT coating and a bond coat, if present) on a turbine blade tip is not critical, so long as the coating is thick enough to provide the desired protection to the underlying substrate from abrasion and/or thermal damage. The thickness of the ABT coating should not be so thick that it interferes with the function of the turbine. Typically, a bond coat, if present, is about 1 to about 3 mils (0.001–0.003 inches) thick, although the bond coat may be thicker, such as 1 to about 10 mils (0.001–0.010 inches) thick. The total thickness of the coating, including the bond coat (if present) and the ABT coating, is typically about 17 mils to about 21 mils (0.017–0.021 inches). On the blade edge, the thickness of the coating may be less than 1.5 times or greater than 4 times the edge radius of the tip of the blade. The precise thickness of the coating, however, is not critical and may be as thin as about 3 mils (0.003 inches) or as thick as 20 to 50 mils (0.020–0.050 inches) or more.

At the sharp edges at the corners of the blade tip, the ABT coating may be of any thickness, as long as the coating at the edges is not so thick as to degrade performance of the turbine. For example, the ABT coating embodiment of the invention may or may not extend beyond the edge of the blade tip. The ratio of the thickness of the coating to the radius of the blade tip edge is immaterial, because an overhang of the coating over the blade tip is not needed for adequate adhesion of the coating. However, the presence of an overhang does not interfere with performance of the coating. Accordingly, this ratio may be as little as zero or it may approach infinity. The STCC of the present invention does not require edge thickness limitations as a buttressing support to achieve acceptable levels of mechanical strength and adhesive bonding to the substrate.

The ABT coating may extend to portions of the turbine blade beyond the blade tip, such as to the blade itself. This extension, however, is not necessary for structural support of the ABT coating or the effectiveness of the ABT coating.

Figure 3:
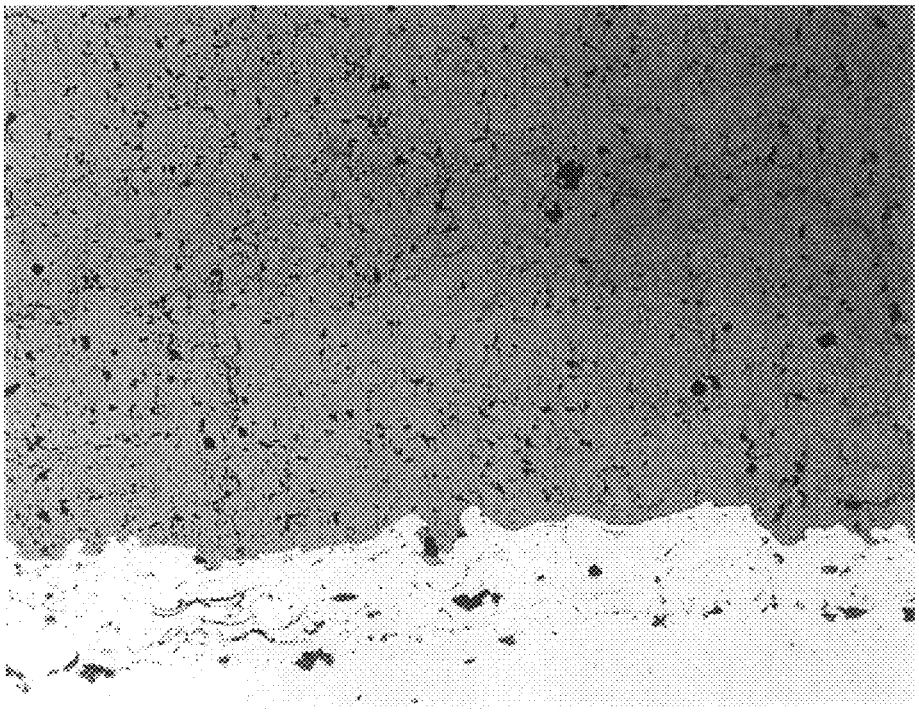
FIG. 3 is a 200X magnification photograph of a yttria-stabilized zirconia STCC of the present invention, used as an abrasive blade tip coating.
Figure 4:
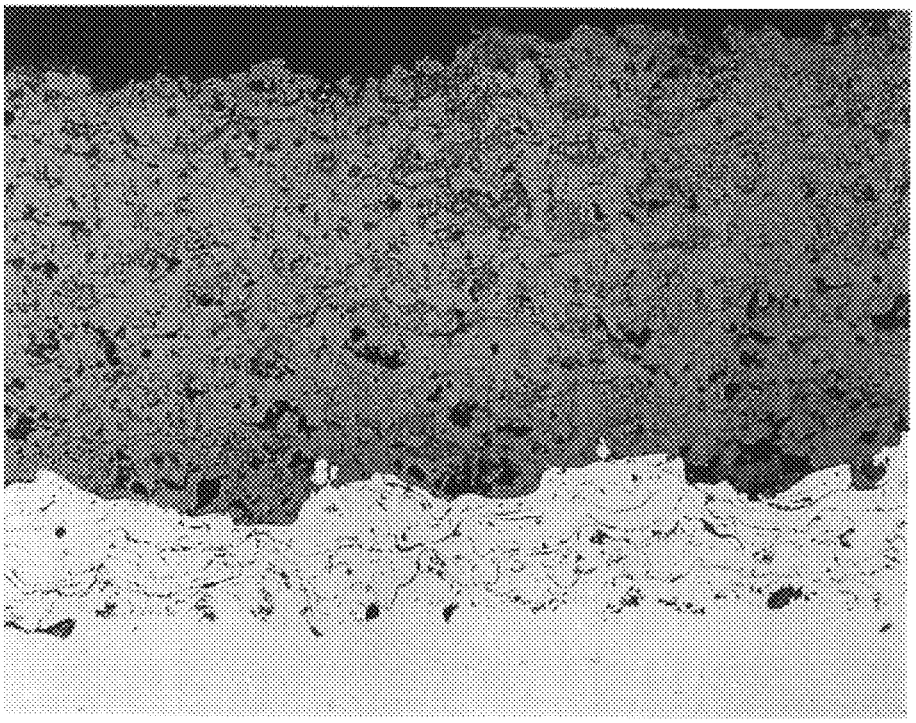
FIG. 4 is a 200X magnification photograph of prior art yttria-stabilized zirconia thermal barrier coating.
Figure 5:
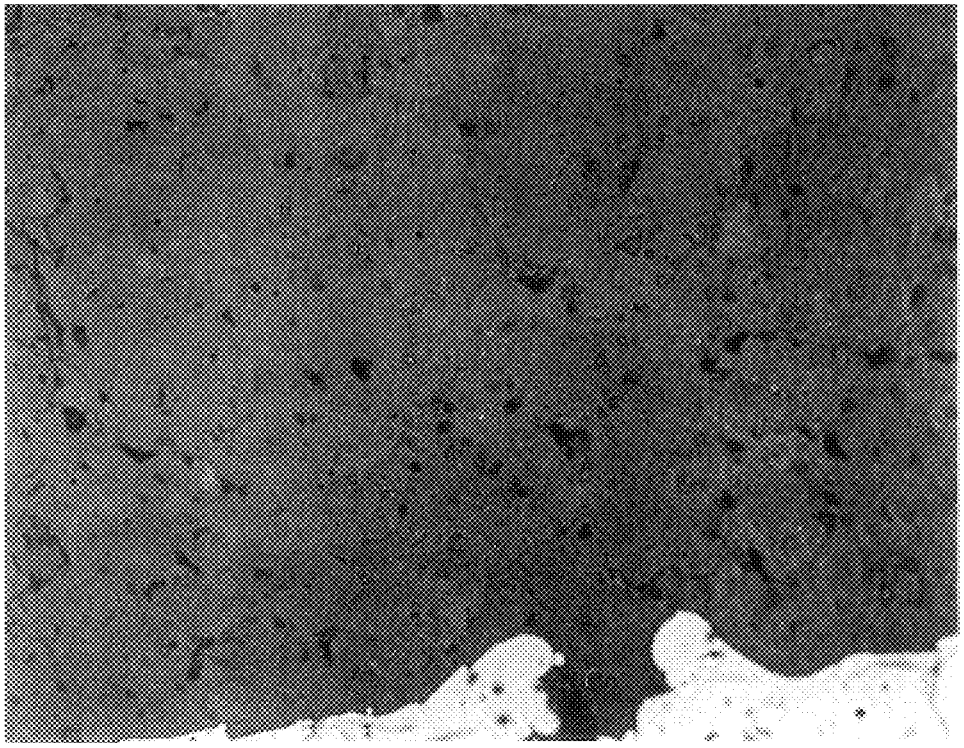
FIG. 5 is a 500X magnification photograph of a yttria-stabilized zirconia STCC of the present invention, used as an abrasive blade tip coating.
Figure 6:
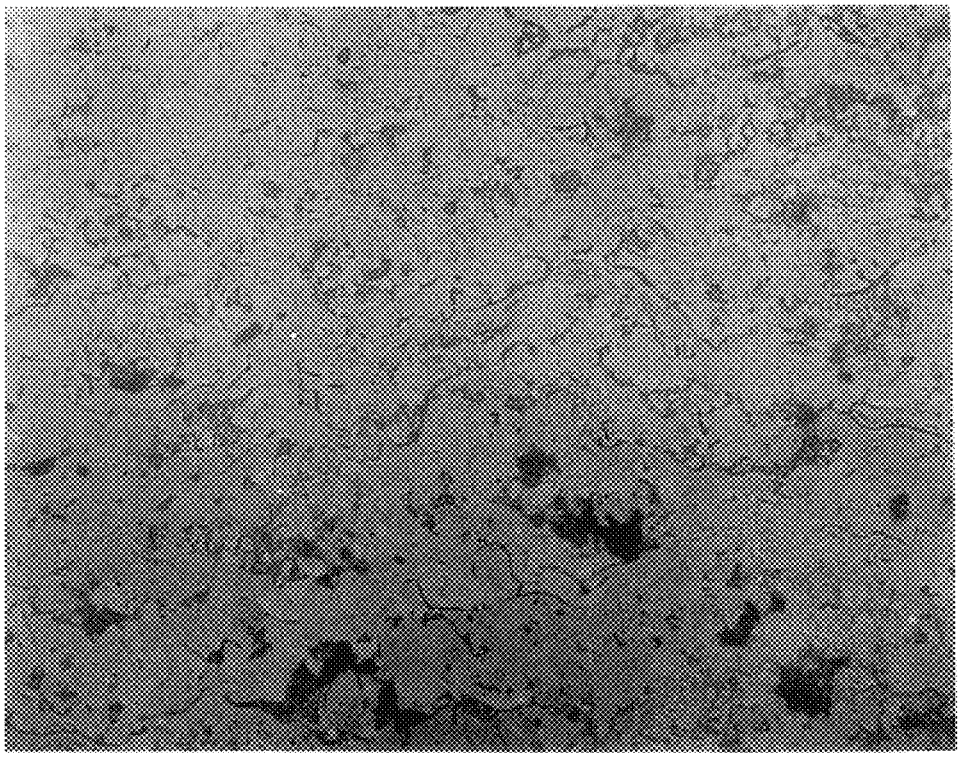
FIG. 6 is a 500X magnification photograph of prior art yttria-stabilized zirconia thermal barrier coating.

FIG. 3 illustrates an as-applied coating of the present invention. There are no visible boundaries or demarcations evidencing intentional macro- or microcracking production. For comparison purposes, FIG. 4 shows a thermal barrier coating of the prior art which shows inner-splat boundaries indicative of a particular application process designed to create macro and/or microcracks. A similar comparison is highlighted by FIGS. 5 and 6, which show, respectively, a coating of the present invention and a thermal barrier coating of the prior art. Comparisons to thermal barrier coatings are made only to illustrate the characteristic differences in the application process.

Figure 8:
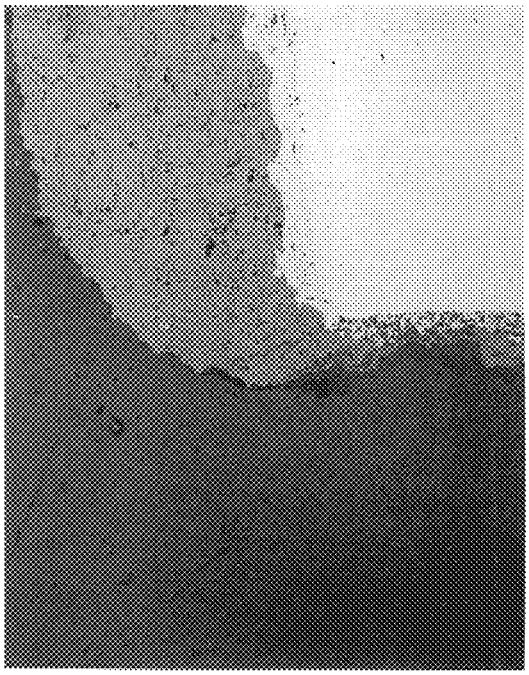
FIG. 8 is a photograph of a turbine blade tip edge coated with a yttria-stabilized zirconia STCC of the present invention, used as an abrasive blade tip coating.
Figure 7:
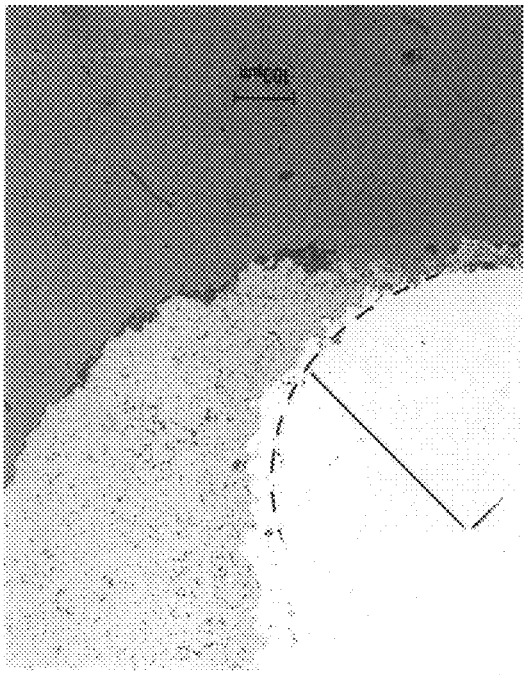
FIG. 7 is a photograph of a turbine blade tip edge coated with a yttria-stabilized zirconia STCC of the present invention, used as an abrasive blade tip coating.

FIG. 8 shows a blade tip edge coated with the STCC of the present invention, used as an ABT coating. The blade tip has an edge which forms an angle of about 90 degrees, resulting in a blade tip edge radius of approximately zero. Thus, the ratio of coating thickness to blade tip radius approaches infinity. FIG. 7 shows a blade tip edge coated with the STCC of the present invention, used as an ABT coating, in which the blade tip has an edge radius of about 1.5 inches at the magnification shown. The ratio of coating thickness to blade tip radius is less than one. These figures show that there is no requirement that the coating of the present invention meet any coating thickness/blade tip radius ratio limitations as required by some prior art ABT coatings.

As applied in accordance with the present invention, the ABT coating embodiment contains substantially no vertical macrocracks or microcracks of vertical or horizontal orientation. As understood herein, a vertical "macrocrack" is a crack or fissure in the coating that extends approximately greater than or equal to 50% of the height of the coating, as measured from the substrate edge (or bond coat edge, if present) to the outer surface of the applied coating. A vertical macrocrack need not form a 90° angle with the substrate surface; thus, a macrocrack is understood herein to include those macrocracks that form a 90°±10° angle with the substrate surface. A "microcrack" is understood herein to refer to cracks or fissures in the coating of comparatively finer width than that of macrocracks. Vertical microcracks extend less than 50% the height of the coating as measured, like macrocracks, from the substrate surface to the outer surface of the coating. Horizontal microcracks are those microcracks that form an angle less than 80°—or greater than 100°—with the substrate surface.

However, it has been observed that an as-applied coating of the present invention, subjected to a cycled exposure of high temperatures in a furnace (at 1600–1900° F.) and then colder temperatures in water at room temperature, exhibits a random (or completely heterogeneous) distribution, population, and orientation of macrocracks and microcracks. The cycled exposure to thermal extremes simulates the thermal stresses that a strain tolerant ceramic coating used as an ABT coating must be able to withstand in service. An as-applied coating subjected to thermal and/or physical stresses commensurate with those experienced by coatings in normal use in a turbine application is thereafter a post-stressed coating. Observations were made upon microscopic examination of a cross-section of the coating. The macrocracks and microcracks observed in the post-stressed coating are not distributed in a planned fashion, nor are they distributed in any particular numerical ratio or population. These macro- and microcracks are not distributed in a homogeneous or "regular" pattern. Moreover, essentially no segmenting or cracking is observed on the coating's surface in the plane of the surface.

It is believed that the STCC of the present invention is therefore able to adapt to the variety of stresses (and strains) placed on it during service by letting the particular stresses (and strains) dictate where relief (in the form of macrocracking and microcracking) exists on a particular coated substrate. In other words, the strain tolerant ceramic coating of the present invention allows an individual turbine blade tip to have a "customized" strain tolerant coating uniquely adapted to the stresses that are specific to that blade tip at that location on a turbine. Since all blade tips are not equally stressed in a turbine, due to pressure and temperature gradients in the turbine system, the adaptive nature of the coatings of the invention is a significant advantage.

Figure 9A:
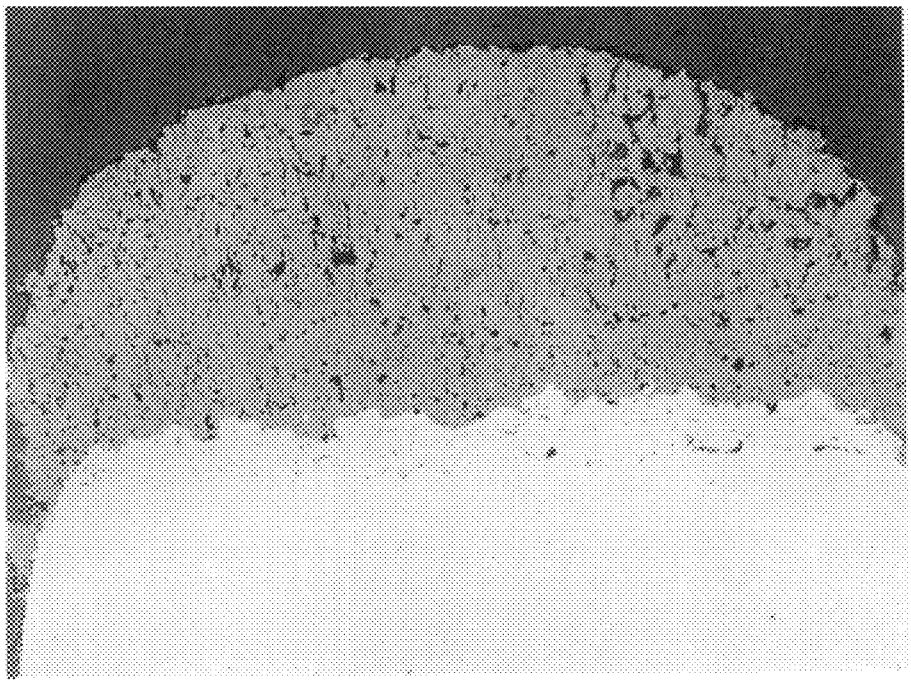
FIG. 9*a* is a photomicrograph (100X) of the edge of a substrate panel coated with a yttria-stabilized zirconia STCC of the present invention, used as an abrasive blade tip coating and shown in the as-applied condition.
Figure 9B:
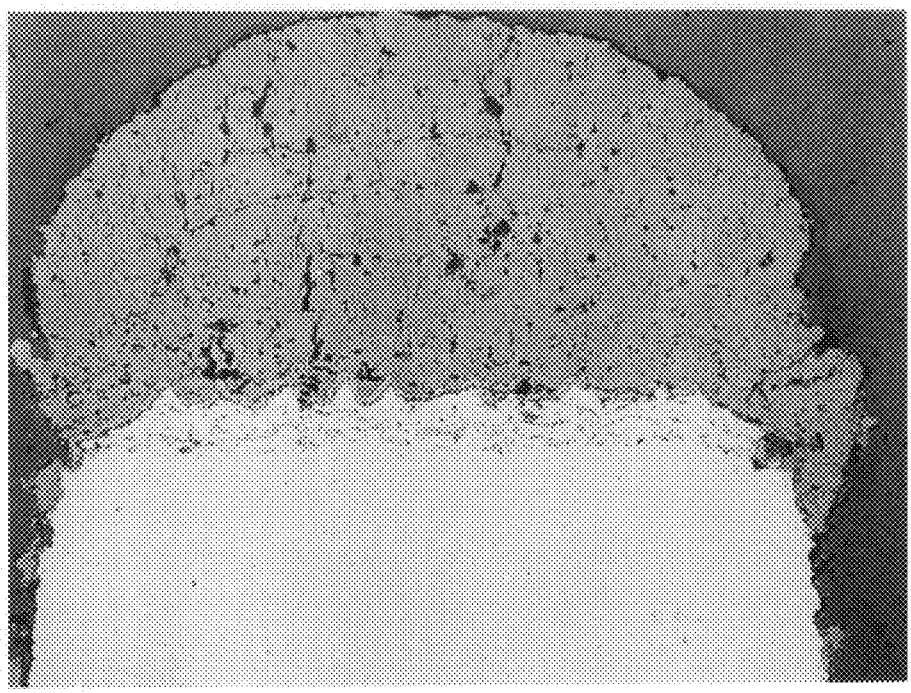
FIG. 9*b* is a photomicrograph (100X) for the panel of FIG. 9*a,* shown in a post-stressed condition.

FIGS. 9*a* and 9*b* illustrate, respectively, the presence of macro- and microcracking in the as-applied and the post-stressed coatings. FIG. 9*a* shows a cross-section of coating free of macrocracks, but shows some evidence of horizontal microcracks resulting from multiple spray passes during deposition (note the upper right portion of this coating).

After testing, as shown in FIG. 9*b*, several more pronounced horizontal microcracks are observed, as well as vertical microcracking. The cracks of the post-stressed coating are not homogeneously distributed, as they are randomly scattered throughout the section viewed.

Figure 10A:
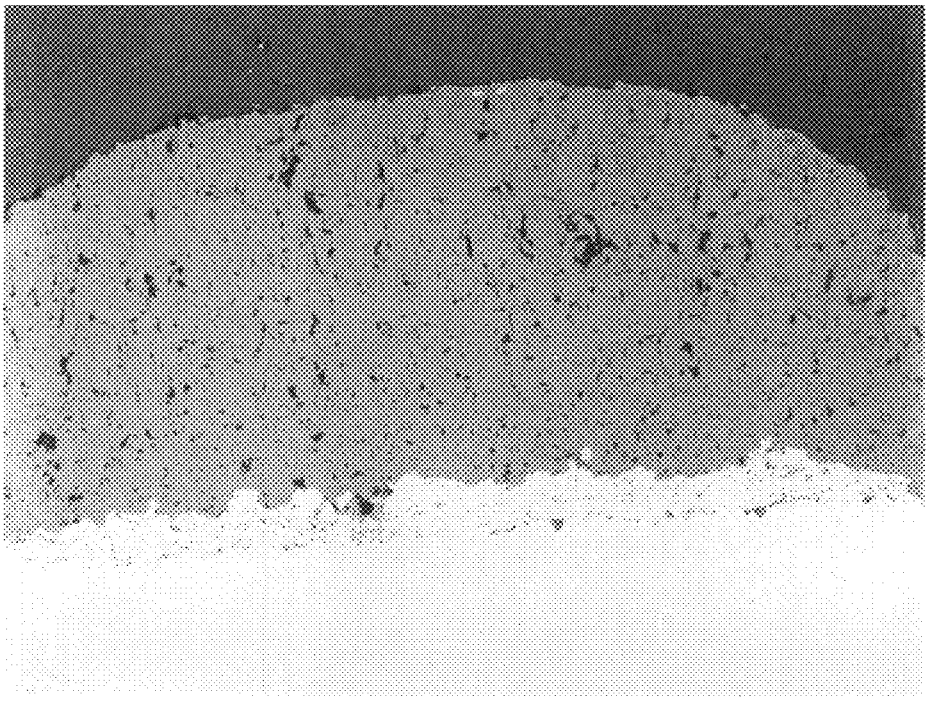
FIG. 10*a* is a photomicrograph (100X) of a the edge of a substrate panel coated with a yttria-stabilized zirconia STCC of the present invention, used as an abrasive blade tip coating and shown in the as-applied condition.
Figure 10B:
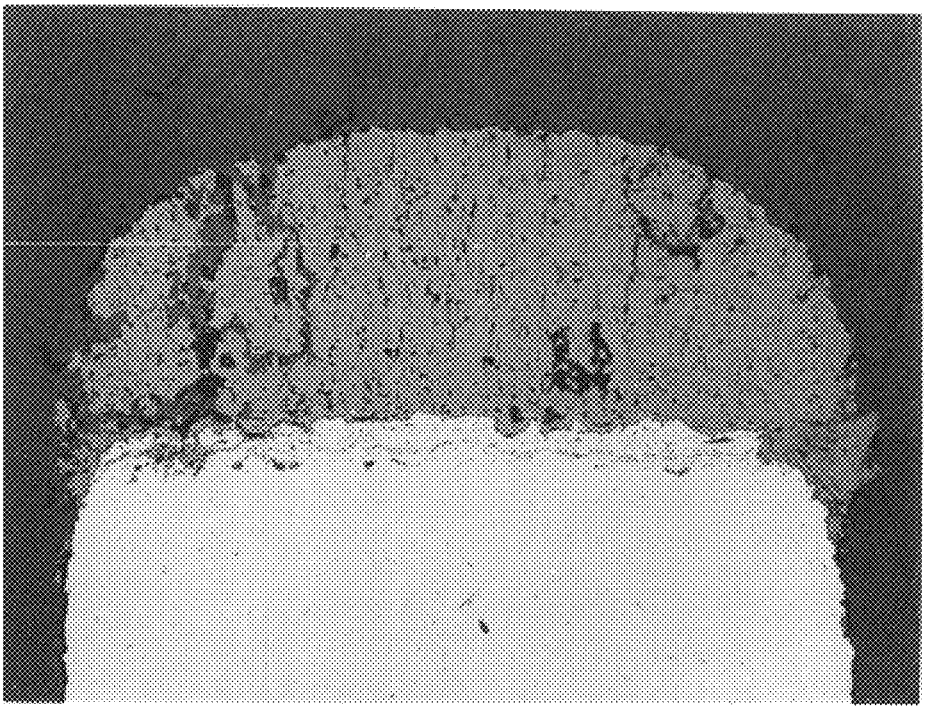
FIG. 10*b* is a photomicrograph (75X) of the panel of FIG. 10*a,* shown in a post-stressed condition.
Figure 11A:
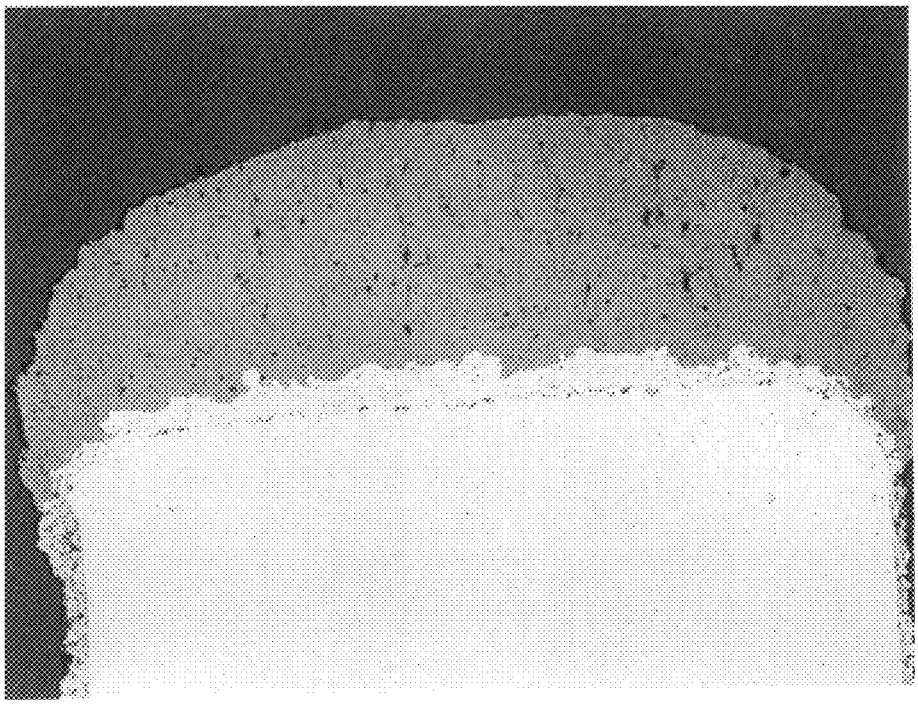
FIG. 11*a* is a photomicrograph (75X) of a turbine blade tip coated with a yttria-stabilized zirconia STCC of the present invention, used as an abrasive blade tip coating and shown in the as-applied condition.
Figure 11B:
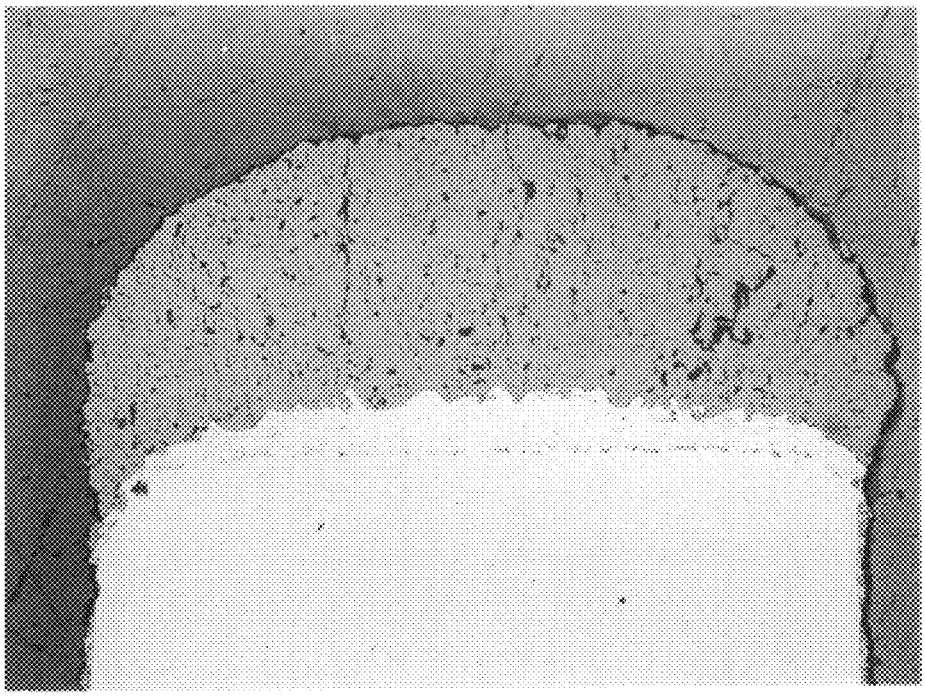
FIG. 11*b* is a photomicrograph of the turbine blade tip of FIG. 11*a,* shown in a post-stressed condition.

FIGS. 10*a* and 10*b* further illustrate the comparison of as-applied and post-stressed coatings. FIG. 10*a* shows a cross-section free of macrocracks and microcracks. FIG. 10*b* again illustrates the heterogeneity of defects or cracks forming as a result of the test. One vertical macrocrack is visible and another substantial crack is seen at an approximate 50 degree angle to the substrate surface. FIGS. 11*a* and 11*b* also evidence the absence of macro- and microcracks from the as-applied coating and the existence of a random distribution of macro- and microcracks in the post-stressed coating.

The coated substrate of the invention may be a metal turbine blade, such as those made using steel, titanium, nickel, cobalt, or alloys thereof. Any metal part that may benefit from the application of an abrasion resistant coating may be coated with the STCC of the invention. Metals suitable as substrates for the coating of the invention include, for example, cobalt, iron, aluminum, zinc, magnesium, nickel, titanium, molybdenum, niobium, tantalum, tungsten, and alloys thereof.

The STCC of the invention is applied to a substrate in any manner suitable to achieve the desired physical properties, and in the case of the ABT embodiment, producing a dense abrasion resistant coating. For example, the coating may be applied by various plasma spraying processes, such as air plasma spraying, inert gas-shrouded plasma spraying, high velocity plasma spraying, and vacuum plasma spraying. In a preferred embodiment, the STCC of the invention is applied by means of a plasma spray process. This process preferably utilizes a Praxair SG-100 torch (Miller Thermal, Inc., Appleton, Wis.). A similar gun is disclosed in U.S. Pat. No. 5,444,209. It is believed that the combination of a small powder particle and the plasma spray process enhance the physical and mechanical properties of the coating of the present invention.

The plasma spray process parameters employed in the production of the coating of the present invention are shown in Table 1. Under these process conditions, the plasma torch thermally melts the powder particles. The use of a plasma torch deposition process, particularly pursuant to the process variables below, is well understood by those skilled in the art. The ranges of values reported in Table 1 for the process parameters reflect normal variations expected during normal operation. In addition to the reported optimal ranges, variations as much as 25% for any parameter value are not expected to cause substantial alteration to the coating of the present invention. The process parameter values presented in Table 1 would be expected to change if a different torch were to be utilized. Thus, the STCC of the present invention could be created under differing optimal conditions if a different torch is utilized because different plasma spray devices promote different momentum and heat transfer characteristics of deposited particles. Unless otherwise described, the coatings used in the Examples below were produced by the process outlined in Table 1.

The plasma spray process using the SG100 torch has been demonstrated to be a robust procedure because application variables may be altered, within the ranges set forth in Table 1, without significantly affecting the quality of the coating. No complicated application schemes, such as deposition/heating/cooling cycles or post-treatment of the coating is required.

TABLE 1

| Process Parameters | |
|---|---|
| Torch Type | Praxair SG-100 |
| Powder Feed Rate, g/min | 35 ± 2 |
| Current, amps | 750 ± 50 |
| Volts, v | 42 ± 1 |
| Standoff, in | 3.0 ± 0.25 |
| Surface Speed, in/min | 800 ± 25 |
| Monolayer height, mils | approx. 3.0 |
| Primary Gas, cfh | Ar, 70 ± 5 |
| Secondary Gas, cfh | He, 110–155 |
| Powder gas, cfh | Ar, 12 ± 2 |

The invention is illustrated by the following non-limiting examples. In these examples, visual microscopic analysis is conducted with an Olympus PMG 3 instrument.

EXAMPLE 1

Three different yttria-stabilized zirconia powders were prepared. These powders were determined to contain the constituents shown below in Table 2.

TABLE 2

| Yttria-stabilized Zirconia Powders | | | |
|---|---|---|---|
| | Powder 1A | Powder 1B | Powder 1C |
| $ZrO_2$ | 91–93% | 91–93% | 92–94% |
| $Y_2O_3$ | 7–9% | 7–9% | 6–8% |
| CaO | 200 ppm | 200 ppm | 2000 ppm |
| $Al_2O_3$ | 100 ppm | 100 ppm | 2000 ppm |
| $SiO_2$ | 500 ppm | 500 ppm | 7000 ppm |
| $TiO_2$ | 300 ppm | 300 ppm | 4000 ppm |
| $HfO_2$ | <1.8% Hf | <1.8% Hf | 2.5% |
| Fe | 50 ppm | 50 ppm | 2000 ppm as $Fe_2O_3$ |
| MgO | <1000 ppm Mg | <1000 ppm Mg | 2000 ppm |

Powders 1A and 1B have the same constituents, but have differing average particle sizes.

By standard techniques using Microtrac analysis and electron microscopy, the average size (equivalent spherical diameter) and shape of the particles in each of the three powders was determined to be as follows:

| Powder | Average Particle Size | Shape |
|---|---|---|
| 1A | 31.79 μm | elongated and angular |
| 1B | about 41 μm | elongated and angular |
| 1C | 57.44 μm | spherical |

Each of the powders, 1A, 1B, and 1C, was applied directly to a nickel-based superalloy substrate using the process described above, to form coatings 2A, 2B, and 2C, respectively. The coatings were applied to an overall thickness in the range of about 425 μm to about 475 μm. Coating 2A is an STCC of the present invention preferably used as an ABT coating. Coatings 2B and 2C are prepared from powders (1B and 1C) representative of the prior art.

EXAMPLE 2

Microscopic evaluation of coating 2A at 500X revealed the presence of one vertical microcrack within a 0.50 inch long section of the coating. Several small, scattered, horizontal microcracks were visible throughout the coating. The density of the coating was determined, by comparison to visual standards, to be in excess of 95% of theoretical density. Thus, coating 2A is deemed to be essentially free of macrocracks.

EXAMPLE 3

A coating using Powder 1A was applied, over a 1 to 3 mil thick NiAl bond coat, to a nickel superalloy turbine blade by the method described above to form a two-layer coating having a total thickness of about 19 to 21 mils. The two layer coating was tested for abrasion and thermal resistance.

Coated blade tips were subjected to rub rig testing against a nickel alloy seal segment at a tip speed of 800 feet/sec at a target rub depth of 30 mils. The ratio of tip wear to seal segment wear was determined. For three readings at differing locations on the same sample, the wear ratio was determined to be 0.014, 0.026, and 0.012. All of these values are well below the "ideal" wear ratio of 0.05 taught in the prior art, as evidenced by U.S. Pat. No. 5,520,516 (Taylor).

These better-than-ideal wear ratios were achieved with the coating of the invention even though the testing was more rigorous than that taught by Taylor, in which the tip speed was 500 feet/sec at a target rub depth of 20 mils. At these less stringent test conditions, three out of four of the samples of Taylor failed to achieve ideal wear ratios.

Thus, the coatings of the present invention exhibit an enhanced lap shear strength, which is essential to abrasive-resistant coatings, particularly those designed to "cut" the shroud in a turbine blade application.

EXAMPLE 4

Blade tips coated with the coating of the invention (e.g., coating 2A of Example 1) over a NiCoCrAlY bondcoat were subjected to a thermal cycle test in which the blade tips were heated to 870° C. (1600° F. ), then rapidly quenched in a bucket of water at 25° C. (77° F.). No separation was noted in the blade tips after 65 cycles of heating and quenching. The coatings of the present invention exhibit strong adhesive bonding to the substrate or bond coat to which it is applied.

A coating made from Powder 1B was applied to a NiCoCrAlY bond coat on nickel superalloy turbine blade tips according to the method described above. The coated blade tips were subjected to the thermal cycle test as described in Example 4, which resulted in severe spalling or separation of the blade tips.

EXAMPLE 5

A coating made from a powder having the constituents of powder 1C, but having an average equivalent spherical diameter of −325 mesh (about 40 μm), was applied to a NiCoCrAlY bond coat on nickel superalloy turbine blade tips according to the method described above. The coated blade tips were subjected to rub testing as described in Example 3, and resulted in severe separation of each of the blade tips.

EXAMPLE 6

Multiple turbine blades were coated with strain tolerant ceramic coatings used as an ABT coating according to the method of the present invention with a powder corresponding to Powder 1A, except that the powders had a smaller average equivalent spherical diameter of about 20 μm to about 25 μm. These coatings pass the rub tests described in Example 3. Turbine blades coated with similar coatings made from powder having an average diameter of 35 μm showed similar passing results for the same tests.

EXAMPLE 7

Coatings made from Powders 1A and 1C were compared in terms of Vickers hardness according to ASTM E384-73 using a 300 g load. The results are summarized below in Table 3 as an average of ten readings.

TABLE 3

Hardness of Coatings Made From Powders of Example 1

| | Powder 1A | Powder 1C |
|---|---|---|
| Vickers Hardness (kg/mm$^2$) | 932 $HV_{300}$ | 528 $HV_{300}$ |
| Std. Deviation | 82 $HV_{300}$ | 123 $HV_{300}$ |
| Coeff. of Variation | 8.8% | 21.4% |

As shown in Table 3, the ABT coating embodiment of the invention, made from powder 1A, is much harder than the prior art blade tip, made from powder 1C. Additionally, as is evident from both standard deviation and coefficient of variation, the ABT coating embodiment of the invention has a much lower variability in terms of hardness than the coating of the prior art.

EXAMPLE 8

Coatings made from Powders 1A and 1C were compared in terms of bond strength according to ASTM C633-79. The coatings were each applied in accordance with the process described above to three stainless steel buttons over a MCrAlY bond coat.

The average bond strength measure for the ABT coating embodiment of the invention was 10903 psi. This compares favorably with the average bond strength of 8993 psi, which was determined for the coating of the prior art (coatings based on Powder 1C).

At the point of failure of the prior art coating, the coating delaminated at the interface between the coating and the bond coat. In contrast, the ABT coating embodiment of the invention did not delaminate at this interface. Failure at the higher tension occurred only at the epoxy used to attach the test apparatus to the ABT coating. It is evident from this test that the ABT coating 1A of the invention has excellent adhesion to a bond coat.

The foregoing Examples illustrate the enhanced physical and mechanical properties of the strain tolerant ceramic coatings of the present invention. The use of yttria-stabilized zirconia powder mixtures having average particulate sizes below 40 μm in preparing coatings via a plasma spray process results in strain tolerant ceramic coatings exhibiting excellent hardness, lap shear strength, resistance to abrasion, and adhesion to a substrate. These coatings further adapt to stresses unique to a particular substrate in a specific service environment. These coatings are also applied in a fast and comparatively inexpensive manner.

It is further understood that the present invention is not limited to the particular embodiments shown and described herein, but that various changes and modifications may be made without departing from the scope and spirit of the invention.

We claim:

1. A strain tolerant ceramic coating for coating a substrate, the coating comprising yttria and zirconia and being prepared from a yttria and zirconia powder having an average particle size less than 40 microns and formed by depositing the powder on said substrate by a plasma spray process, wherein an as-applied coating contains essentially no macrocracks and wherein a post-stressed coating contains a random distribution, population, and orientation of microcracks and macrocracks.

2. A coating as in claim 1, wherein the powder contains a molar ratio of zirconia to yttria in the range from about 18:1 to about 29:1.

3. A coating as in claim 1, wherein the theoretical density of the coating is greater than 88%.

4. A strain tolerant ceramic coating for use as an abrasive coating on a substrate, the coating comprising yttria and zirconia and being prepared from a yttria and zirconia powder having an average particle size less than 40 microns and formed by depositing the powder on said substrate by a plasma spray process, wherein an as-applied coating contains essentially no macrocracks and wherein a post-stressed coating contains a random distribution, population, and orientation of microcracks and macrocracks.

5. A coating as in claim 4, wherein the powder contains a molar ratio of zirconia to yttria in the range from about 18:1 to about 29:1.

6. A coating as in claim 4, wherein the theoretical density of the coating is greater than 88%.

7. A coating as in claim 4, wherein a substrate with said coating deposited thereon has a substrate/seal segment wear ratio of less than 0.05, the wear ratio determined by conducting a rub rig test against a corresponding seal segment at a speed of 800 feet/s at a target rub depth of 30 mils.

8. A coating as in claim 7, wherein the wear ratio is less than 0.03.

9. A coating as in claim 4, wherein said coating has a Vickers hardness greater than about 800 $HV_{300}$, as determined by ASTM E384-73.

10. A coating as in claim 4, wherein said coating has a bond strength to the substrate higher than 10,000 psi, as determined by ASTM C633-79.

11. A strain tolerant ceramic coating for use as an abrasive blade tip coating on turbine blades comprising a first metal oxide and a second metal oxide, the first metal oxide selected from the group consisting of oxides of yttrium, calcium, magnesium, and cerium, the second metal oxide selected from the group consisting of oxides of zirconium, aluminum, and chromium;

the coating being prepared from a powder comprising particles of the first metal oxide and the second metal oxide, the powder having an average particle size less than 40 microns;

the coating formed by depositing the powder on said substrate by a plasma spray process, wherein an as-applied coating contains essentially no macro cracks and wherein a post-stressed coating contains a random distribution, population, and orientation of micro cracks and macro cracks.

12. A coating as in claim 11, wherein the first metal oxide is an oxide of yttrium and the second metal oxide is an oxide of zirconium, the powder containing a molar ratio of second metal oxide to first metal oxide in the range from about 18:1 to about 29:1.

13. A coating as in claim 11, wherein the theoretical density of the coating is greater than 88%.

14. A coating as in claim 11, wherein a substrate with said coating deposited thereon has a substrate/seal segment wear ratio of less than 0.05, the wear ratio determined by conducting a rub rig test against a corresponding seal segment at a speed of 800 feet/s at a target rub depth of 30 mils.

15. A coating as in claim 14, wherein the wear ratio is less than 0.03.

16. A coating as in claim 13, wherein said coating has a Vickers hardness greater than about 800 $HV_{300}$, as determined by ASTM E384-73.

17. A coating as in claim 11, wherein said coating has a bond strength to the substrate higher than 10,000 psi, as determined by ASTM C633-79.

18. A metal article having a coating deposited thereon, the coating comprising yttria and zirconia;

the coating being prepared from a yttria and zirconia powder having an average particle size less than 40 microns;

the coating formed by depositing the powder on said article by a plasma spray process, wherein an as-applied coating contains essentially no macrocracks and wherein a post-stressed coating contains a random distribution, population, and orientation of microcracks and macrocracks.

19. A metal article as in claim 18, wherein the article is a turbine blade.

20. A metal article as in claim 18, wherein said coating is deposited on a bond coat, the bond coat being directly applied to the metal article.

21. A process for producing a strain tolerant ceramic coating for use as an abrasive blade tip coating on a substrate comprising the steps of:

(a) depositing a yttria and zirconia powder on said substrate by thermally melting the powder with a plasma torch, the powder comprising particles having an average particle size less than 40 microns;

(b) forming a monolayer on the substrate of about 3.0 mil, (c) repeating steps (a) and (b) at least once until a coating of a desired total thickness is achieved, the coating containing essentially no macrocracks in the as-applied state and wherein a post-stressed coating contains a random distribution, population, and orientation of microcracks and macrocracks.

22. A process for producing a strain tolerant ceramic coating as set forth in claim 21, wherein the substrate has a bond coat deposited thereon prior to deposition of the strain tolerant ceramic coating.

* * * * *